US009052636B2

(12) United States Patent
Hirobe

(10) Patent No.: US 9,052,636 B2
(45) Date of Patent: Jun. 9, 2015

(54) IMAGE FORMING APPARATUS

(71) Applicant: CANON KABUSHIKI KAISHA, Tokyo (JP)

(72) Inventor: Fumitake Hirobe, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 36 days.

(21) Appl. No.: 13/763,868

(22) Filed: Feb. 11, 2013

(65) Prior Publication Data

US 2013/0230333 A1 Sep. 5, 2013

(30) Foreign Application Priority Data

Mar. 1, 2012 (JP) ..... 2012-044980

(51) Int. Cl.
*G03G 15/00* (2006.01)
*G03G 15/08* (2006.01)

(52) U.S. Cl.
CPC ..... *G03G 15/0846* (2013.01); *G03G 15/0848* (2013.01); *G03G 15/0887* (2013.01); *G03G 15/0893* (2013.01)

(58) Field of Classification Search
CPC ..... G03G 15/0848; G03G 15/0846; G03G 15/0887; G03G 21/20–21/203
USPC ..... 399/44, 97, 253–256
See application file for complete search history.

(56) References Cited

U.S. PATENT DOCUMENTS 5,819,132 A 10/1998 Hirobe
6,142,016 A * 11/2000 Kobayashi et al. ..... 73/295
6,442,355 B2 8/2002 Hasegawa et al.
7,218,870 B2 5/2007 Hirobe
8,385,754 B2 2/2013 Hirobe et al.
2011/0158665 A1* 6/2011 Yamauchi ..... 399/44

FOREIGN PATENT DOCUMENTS

JP 63-177177 A 7/1988
JP 2808108 B2 10/1998
JP 11-212343 A 8/1999
JP 2006-139140 A 6/2006
JP 2007-41233 A 2/2007
JP 2008-197179 A 8/2008

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes an image bearing member which bears an electrostatic latent image, a development device which includes a developer bearing member conveying developer, a developing container containing the developer, and a stirring member stirring the developer inside the developing container. In addition, a first detecting portion detects information regarding humidity of the developer, a second detecting portion is disposed at a different position from the first detecting portion and detects information regarding humidity of the developer, and a controller starts image forming after driving the stirring member for a predetermined period after receiving an image forming signal. The controller controls to extend the predetermined period when a difference between the detecting result from the first detecting portion and the second detecting portion is larger than a predetermined value.

3 Claims, 10 Drawing Sheets

IMAGE FORMING APPARATUS

BACKGROUND OF THE INVENTION

1. Field of the Invention

The present invention relates to an electrophotographic system image forming apparatus.

2. Description of the Related Art

In an electrophotographic system image forming apparatus, a charging amount of toner is easily influenced by an environment condition, that is, a surrounding ambient temperature and humidity or the like. For example, when the humidity is changed, an amount of moisture attached to the surface of developer is changed. Therefore, the charging amount of toner is changed, and thus the density of an output image is varied.

Accordingly, control has been suggested in which an absolute humidity (amount of moisture per unit volume) or relative humidity in developer is detected from a result detected by an environment sensor installed inside an apparatus body or near a development device and an image formation condition is changed (see Japanese Patent Laid-Open No. 2006-139140).

In humidity conditioning of developer, some time is required and it takes more time to perform moisture absorption than moisture removal. The humidity conditioning refers to a phenomenon in which a previously formed ambient state is adapted to a currently formed ambient state. The moisture absorption refers to humidity conditioning from low humidity to high humidity. The moisture removal refers to humidity conditioning from high humidity to low humidity.

Thus, according to Japanese Patent No. 2808108, developer humidity conditioning characteristics are corrected by history control. Specifically, the control is performed such that a change in temperature or humidity is measured by an environment sensor for each predetermined time, a humidity conditioning direction and a humidity conditioning degree are determined, and a development contrast potential is calculated.

Further, according to Japanese Patent Laid-Open No. 2007-41233, control is performed such that an idle rotation time of a developing container (developer) is determined based on a pause time of an image forming apparatus to correct a change in the charging amount of toner based on the pause time.

However, with recent improvement in color of a document, a high demand for stability of a density or a color has been made. In order to satisfy the demand, it is important to accurately comprehend and control a behavior of a humidity change of the developer. However, the demand has not been satisfied in the related art.

For example, in Japanese Patent Laid-Open No. 2006-139140 and Japanese Patent No. 2808108, during the pause time of an image forming apparatus, a humidity conditioning state distribution (hereinafter, referred to as uneven humidity conditioning) between the developer coming into contact with the surrounding ambient and the developer of a lower portion of a development device coming into no contact with the ambient is not considered on a sleeve and the surface of the developer. Therefore, in Japanese Patent Laid-Open No. 2006-139140 and Japanese Patent No. 2808108, it is difficult to perform the control with high accuracy, when an image forming operation is paused.

On the other hand, in Japanese Patent Laid-Open No. 2007-41233, the uneven humidity conditioning is resolved by performing idle rotation during the pause time and stirring the developer. However, since the idle rotation is performed excessively, a problem may arise in that a transfer failure of image due to deterioration in toner (specifically, an external additive is buried to toner) may occur or a process start time of an image forming apparatus body may increase.

SUMMARY OF THE INVENTION

It is desirable to provide an image forming apparatus capable of performing control with high accuracy by exactly comprehending a humidity conditioning behavior of developer when driving of the image forming apparatus is paused, and thus improving stability of a density and a color.

In order to solve the problem, an image forming apparatus according to an aspect of the invention includes: an image bearing member which bears an electrostatic latent image; a development device which includes a developer bearing member conveying developer to a development position facing the image bearing member that bears the electrostatic latent image and a stirring member stirring the developer inside a developing container and which develops the electrostatic latent image born on the image bearing member; an acquiring portion which acquires information regarding humidity of the developer at a different position inside the developing container; and a controller which is able to execute a mode in which the stirring member is rotated with image formation start signal before an image forming operation; wherein the controller controls a driving condition of the stirring member at a time of the mode based on data acquired by the acquiring portion.

Further features of the present invention will become apparent from the following description of exemplary embodiments with reference to the attached drawings.

DESCRIPTION OF THE EMBODIMENTS

First Embodiment

Figure 1:
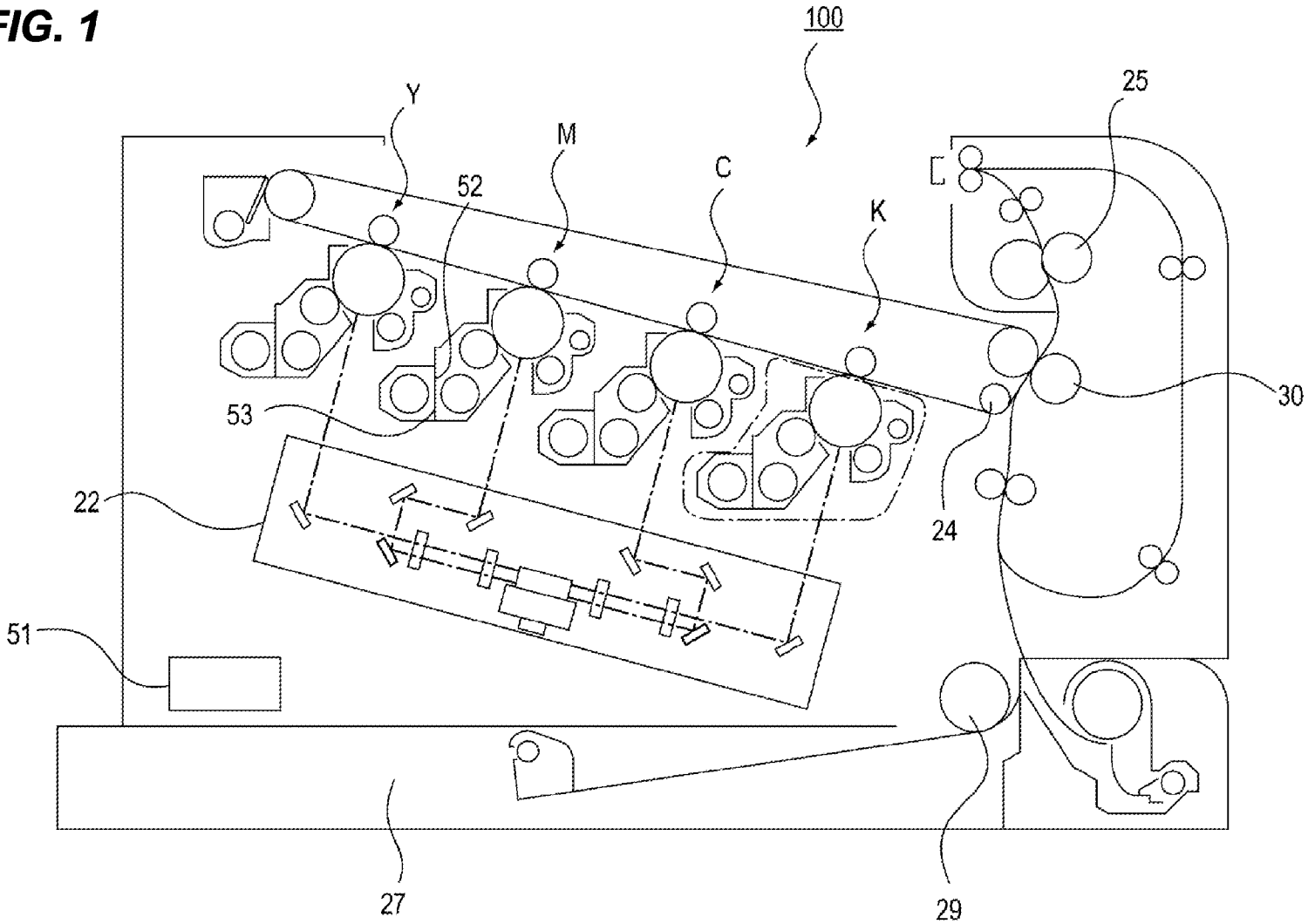
FIG. 1 is a diagram illustrating the configuration of an image forming apparatus according to a first embodiment.
Figure 2:
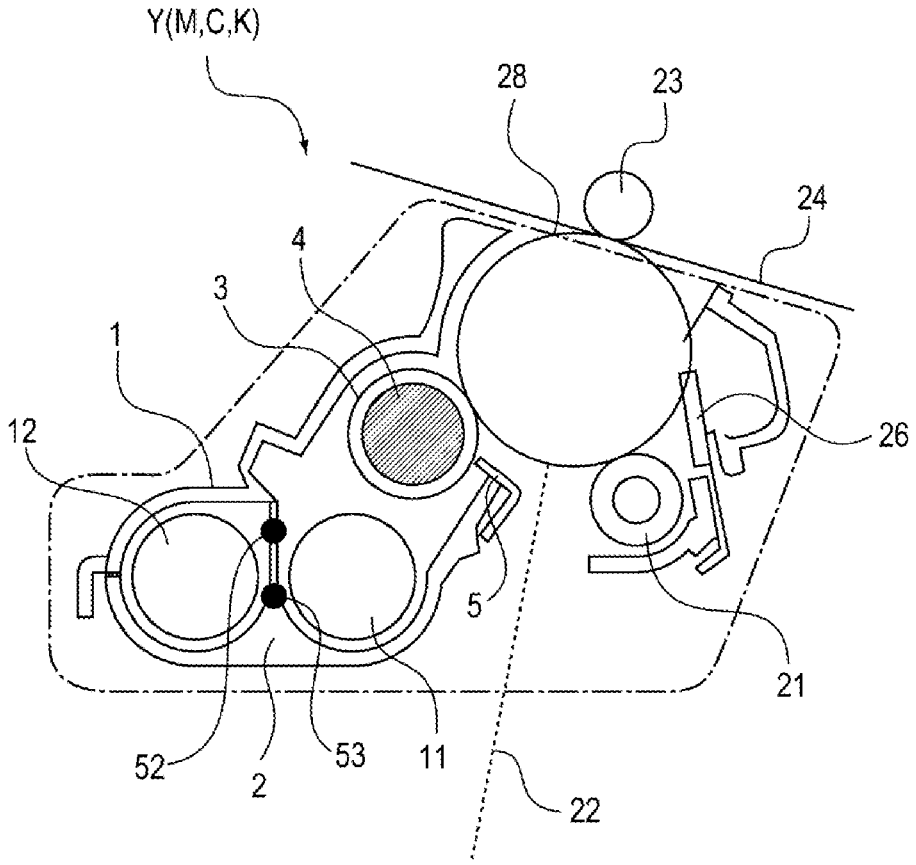
FIG. 2 is a diagram illustrating the configuration of a drum cartridge of the image forming apparatus according to the first embodiment.

An image forming apparatus according to a first embodiment of the invention will be described with reference to the drawings. FIG. 1 is a diagram illustrating the configuration of the image forming apparatus according to this embodiment. FIG. 2 is a diagram illustrating the configuration of a drum cartridge of the image forming apparatus according to this embodiment.

As illustrated in FIGS. 1 and 2, an image forming apparatus 100 according to this embodiment includes four drum cartridges Y, M, C, and K of yellow, magenta, cyan, and black. The drum cartridges Y to K have the same configuration except for the different toner colors.

In each of the drum cartridges Y to K, a photosensitive drum (image bearing member) 28 is charged by a primary charger 21 and is exposed with a laser 22, so that an electrostatic latent image is formed. The formed electrostatic latent image is developed to a toner image using each color toner by the development device 1. The developed color toner images are primarily transferred to an intermediate transfer belt 24 in an overlapping manner by a primary transfer roller 23. The toner remaining on the photosensitive drum 28 after the primary transfer is removed by a cleaner 26.

On the other hand, a sheet P stacked in a cassette 27 is conveyed by a conveying roller 29 and the toner images primarily transferred to the intermediate transfer belt 24 are secondarily transferred by a secondary transfer roller 30. The sheet P to which the toner images are secondarily transferred is pressed and heated by a fixing device 25 so that the toner images are fixed, and then the sheet P is discharged to the outside of the image forming apparatus.

(Development Device 1) The development device 1 includes a developing container 2. The developing container 2 is opened in a part facing the photosensitive drum 28, and a development sleeve (developer bearing member) 3 is rotatably installed to be partially exposed to this opening. The development sleeve 3 includes a fixed magnet 4. In a development operation, two-component developer within the developing container 2 is retained in a layered state in the development sleeve 3 being rotated and an amount of developer is regulated by a blade 5.

The developer born on the development sleeve 3 forms a magnetic brush napped in a development region. The magnetic brush comes into contact with or closely approximates the surface of the photosensitive drum 28, supplies the toner in the two-component developer according to the electrostatic latent image formed on the surface of the photosensitive drum 28, and develops the electrostatic latent image. The developer remaining after the development of the electrostatic latent image is conveyed with the rotation of the development sleeve 3 and is recovered to the developing container 2.

Figure 3:
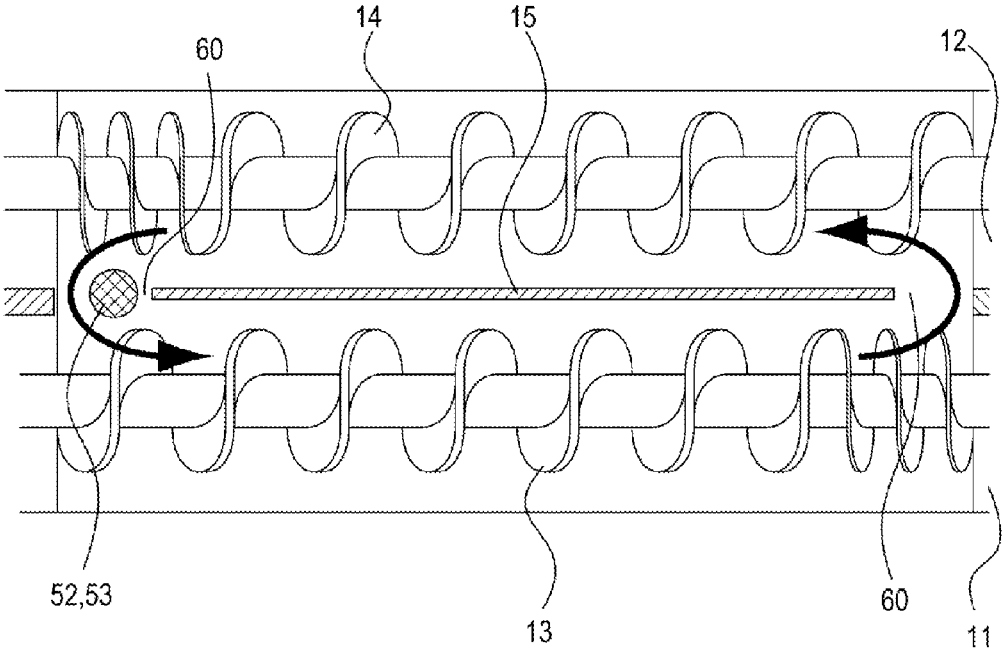
FIG. 3 is a sectional view illustrating a developing container in a length direction according to the first embodiment.

FIG. 3 is a sectional view illustrating the developing container 2 in the length direction according to this embodiment. As illustrated in FIGS. 2 and 3, the developing container 2 can be partitioned into a development chamber 11 and a stirring chamber 12 by a partition wall 15. Communication portions 60 that permit the developer to pass between the development chamber 11 and the stirring chamber 12 are formed at both ends of the partition wall 15 in the length direction.

A first screw (stirring member) 13 that conveys the developer is installed in the development chamber 11. A second screw (stirring member) 14 that conveys the developer is installed in the stirring chamber 12. The developer is mixed and stirred while being circulated within the developing container 2 with the rotation of the first screw 13 and the second screw 14.

(Humidity Conditioning Time and Uneven Humidity Conditioning) An experiment is carried out on the uneven humidity conditioning of the developer (toner) which causes a variation in color. When the ambience (environment) of the surrounding of the developer is changed, it takes some time to perform the humidity conditioning of the developer. Further, when the driving of the development device 1 is paused (non-running state), it is considered that since the developer is not stirred, there is a difference in the humidity conditioning time between the development coming into contact with the ambience and the developer coming into no contact with the ambience.

Figure 7A:
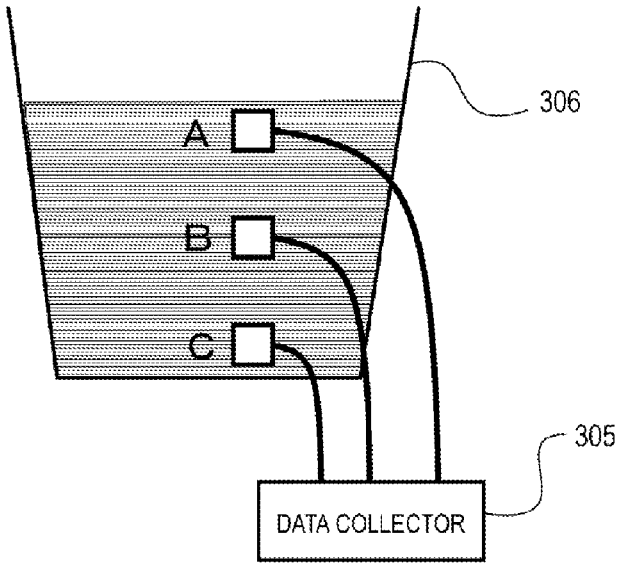
FIG. 7A is a diagram illustrating the configuration of an experiment device that examines a humidity conditioning time difference of the developer.

Accordingly, in the following experiment, it is examined whether there is a time difference between the humidity conditioning time of the top-side portion of the developer coming into contact with the surrounding ambience and the humidity conditioning time of the bottom portion of the developer. FIG. 7A is a diagram illustrating the configuration of an experiment device that examines the humidity conditioning time difference of the developer.

As illustrated in FIG. 7A, developer of 250 g is prepared which is sufficiently subjected to the humidity conditioning under an environment of low temperature and low humidity (23° C. and 5%) and put into a polycup 306 of 200 cc. In the polycup 306, a plurality of holes (in this experiment, three holes A, B, and C) is punched in the height direction of the polycup. A temperature and humidity sensor is inserted into each hole and a dedicated data collector 305 collects temperature and humidity data at measurement points A, B, and C.

The polycup 306 is put into a vinyl bag for a condensation countermeasure and is moved to a constant temperature zone under an environment of high temperature and high humidity (30° C. and 80%), and temperature conditioning is performed. Thereafter, the vinyl bag is opened and humidity conditioning times (humidity change transitions) are measured at developer points A, B, and C.

Figure 7B:
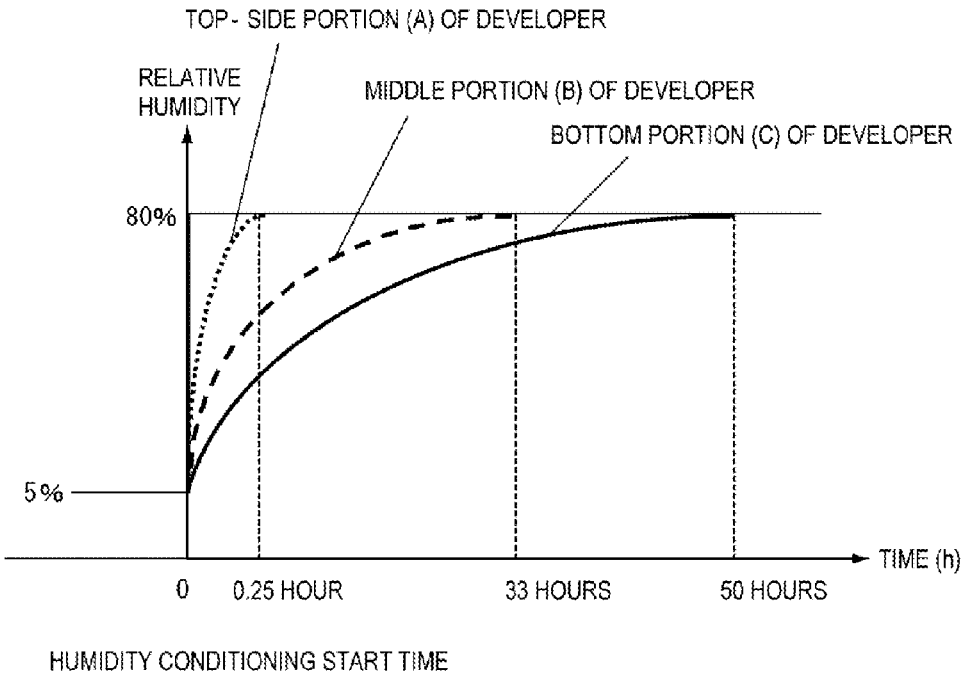
FIG. 7B is a diagram illustrating the humidity conditioning time difference between the developer of a top-side portion of the developer and the bottom portion of the developer.

FIG. 7B is a diagram illustrating an experiment result. The horizontal axis represents a temporal transition and the vertical axis represents the humidity of the developer at each of the points A, B, and C. The origin represents a time at which the vinyl bag is opened and the humidity conditioning starts. As illustrated in FIG. 7B, the times (humidity conditioning times) taken to be familiar with the humidity of 80% in the constant temperature zone are about 15 minutes at the top-side portion (A) of the developer, a time after 33 hours at the middle portion (B) of the developer, and 50 hours at the bottom portion (C) of the developer.

To confirm the temporal transitions of the charging amount of toner at the points A, B, and C, the developer is collected from each point for each predetermined time and the charging amount of toner is measured using a toner particle charging amount distribution measurement device (Espart Analyzer made by Hosokawa Micron Corporation).

As a result, it can be understood that the charging amount of toner and the humidity in the developer have a high correlation, and thus the charging amount of toner is changed with a change in the humidity. Further, it can be confirmed that at the familiar times (15 minutes, 33 hours, and 50 hours) necessary for the points A, B, and C, the charging amount of toner at each point first coincide with the saturated charging amount of toner under the environment of the constant temperature zone (a completely humidity conditioning state in which there is no uneven humidity conditioning).

According to the above-described experiment, when the ambience outside the image forming apparatus is considerably changed during the pause of the development device 1, it can be confirmed that there is a big difference (uneven humidity conditioning) in the humidity conditioning degree in the developer. Since the uneven humidity conditioning causes a variation in color, temperature and humidity sensors 52 and 53 that measure uneven humidity conditioning are provided in this embodiment.

(Temperature And Humidity Sensors 51, 52, and 53) The image forming apparatus 100 includes temperature and humidity sensors (acquiring portions) 51, 52, and 53. The temperature and humidity sensors 51, 52, and 53 acquire information regarding the humidity of the developer at different positions inside the developing container. The temperature and humidity sensors 52 and 53 respectively detect the humidity of the developer at first and second positions of different depths in the developer accommodated inside the developing container. The temperature and humidity sensor (third temperature and humidity measuring unit) 51 measures the temperature and humidity (in this embodiment, detects the absolute humidity (also can detect relative humidity)) of the ambience inside the image forming apparatus. The temperature and humidity sensor (first temperature and humidity measuring unit) 52 comes into contact with the top-side portion of the developer and measures the temperature and humidity (relative humidity) of the top-side portion of the developer. The temperature and humidity sensor (second temperature and humidity measuring unit) 53 comes into contact with the bottom portion of the developer and measures the temperature and humidity (relative humidity) of the bottom portion of the developer. Thus, since the temperature and humidity distributions in the developer can be directly measured, the uneven humidity conditioning of the developer can be detected.

The temperature and humidity sensors 52 and 53 can be installed at positions at which there is no interference with the screws 13 and 14, there is a flow of the developer, and resistance is strong against noise such as high pressure. Accordingly, in this embodiment, as illustrated in FIGS. 2 and 3, the temperature and humidity sensors 52 and 53 are disposed in the top-side portion and the bottom portion of the developer of the communication portions 60 in which the developer is received and given between the stirring chamber 12 and the development chamber 11.

Figure 6A:
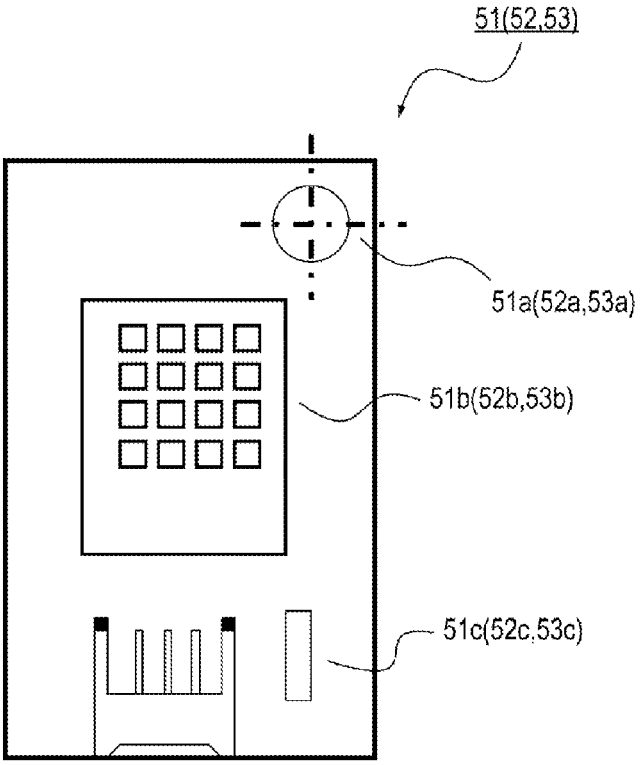
FIG. 6A is a diagram illustrating the configuration of a temperature and humidity sensor according to the first embodiment.
Figure 6B:
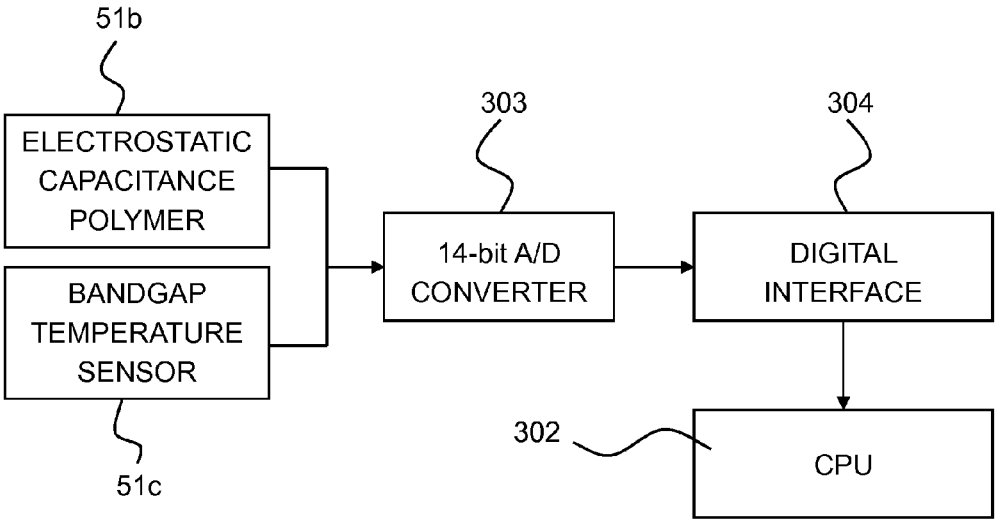
FIG. 6B is a block diagram illustrating the temperature and humidity sensor according to the first embodiment.

FIG. 6A is a diagram illustrating the configuration of the temperature and humidity sensors 51 to 53. FIG. 6B is a block diagram illustrating the temperature and humidity sensors 51 to 53. As illustrated in FIGS. 6A and 6B, the temperature and humidity sensors 51 to 53 include attachment members 51*a* to 53*a*, electrostatic capacitance polymers (humidity detection devices) 51*b* to 53*b*, and bandgap temperature sensors (temperature detection devices) 51*c* to 53*c*, respectively. The attachment members 51*a* to 53*a* support the electrostatic capacitance polymers 51*b* to 53*b* and the bandgap temperature sensors 51*c* to 53*c*, respectively.

The electrostatic capacitance polymers 51*b* to 53*b* are capacitors into which a polymer is inserted as a dielectric material. The humidity is detected using the fact that the amount of moisture adsorbed to the polymer is changed with a change in humidity and the electrostatic capacitance of the capacitor is consequently changed. The bandgap temperature sensors 51*c* to 53*c* calculate temperature based on a resistance value using a thermistor of which a resistance value is linearly changed with respect to temperature.

An example of the temperature and humidity sensors 51 to 53 is the temperature and humidity sensor SHT1X manufactured by Sensirion AG. The temperature and humidity sensors 51 to 53 are all configured to be coupled with a 14-bit A/D converter 303 and transmit data to the CPU 302 and a controller (estimating unit) 301 via a digital interface 304.

(Image Processing Unit and Controller 301)

Figure 4:
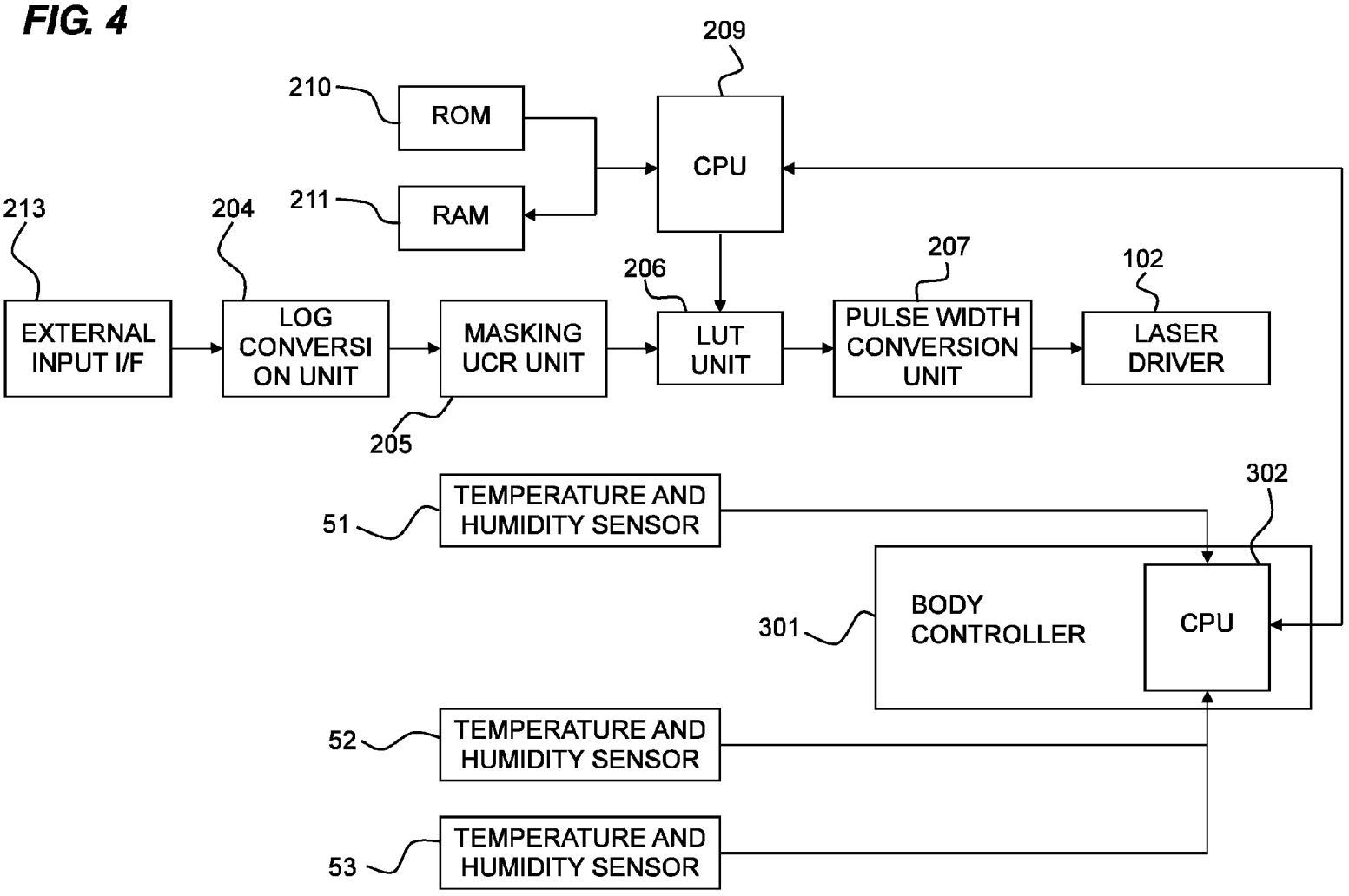
FIG. 4 is a block diagram illustrating the system configuration of an image processing unit and a controller of the image forming apparatus according to the first embodiment.

FIG. 4 is a block diagram illustrating the system configuration of an image processing unit and a controller of the image forming apparatus according to this embodiment. As illustrated in FIG. 4, color image data is input as RGB image data from an external apparatus (not illustrated) such as an original scanner or a computer (information processing apparatus) to the image processing unit via an external input interface (external input I/F) 213.

Luminance data of the input RGB image data is converted into YMC density data (YMC image data) by a LOG conversion unit 204 based on a lookup table (LUT) including data stored in a ROM 210.

Black (K) component data is extracted from the YMC image data by a masking UCR portion 205. Then, in order to correct the turbidity of a recording color material, matrix calculation is performed on the YMCK image data. In order to match the ideal gray scale characteristics of a printer portion, a lookup table unit (LUT unit) 206 performs density correction on each color of the YMCK image data using a γ lookup table. The γ lookup table is generated based on data loaded on the RAM 211 and the contents of this table are set by the CPU 209.

The image data (image signal) subjected to the density correction is output as a pulse signal with a pulse width corresponding to a level of the image data (image signal) by a pulse width modulating unit 207. Then, a laser driver 102 drives the laser 22 based on the pulse signal to irradiate the photosensitive drum 28 and form an electrostatic latent image.

The above-described image processing is generally performed by the controller 301. The controller 301 causes the CPU 302 included thereon to basically operate and cooperate with the CPU 209 on the side of the image processing unit via an interface. The controller 301 is able to execute a mode in which the screws 13 and 14 are idly rotated with the image formation start before an image forming operation. The controller 301 determines the execution or non-execution of the idle rotation mode or a driving condition of the screws 13 and 14 in the idle rotation mode based on the data acquired by the acquiring portion.

The controller 301 detects whether uneven humidity conditioning occurs in the developer based on the temperature and humidity inside the image forming apparatus body and the temperature and humidity of the top-side portion and the bottom portion of the developer which are transmitted from the temperature and humidity sensors 51 to 53. Specifically, "an uneven humidity conditioning index (γ)=|a humidity value of the bottom portion of the developer−a humidity value of the top-side portion of the developer|" is calculated as the uneven humidity conditioning. That is, the uneven humidity conditioning is defined as an absolute value of a difference between the humidity value of the bottom portion and the top-side portion of the developer. When the difference between the humidity value of the top-side portion of the developer and the humidity value of the bottom portion of the developer is large, it is determined that the uneven humidity conditioning is large.

When the uneven humidity conditioning is large, in order to suppress a variation in a color, the idle rotation of the screws 13 and 14 and the stirring of the developer are required to resolve the uneven humidity conditioning. Thus, when the calculated uneven humidity conditioning index (γ) is greater than a predetermined threshold value (in this embodiment, 15% RH), the controller 301 determines that the idle rotation is required, and thus rotates the screws 13 and 14. Based on the results measured by the temperature and humidity sensors 51 to 53, an image formation condition determined in advance is set and an image is formed.

Figure 5:
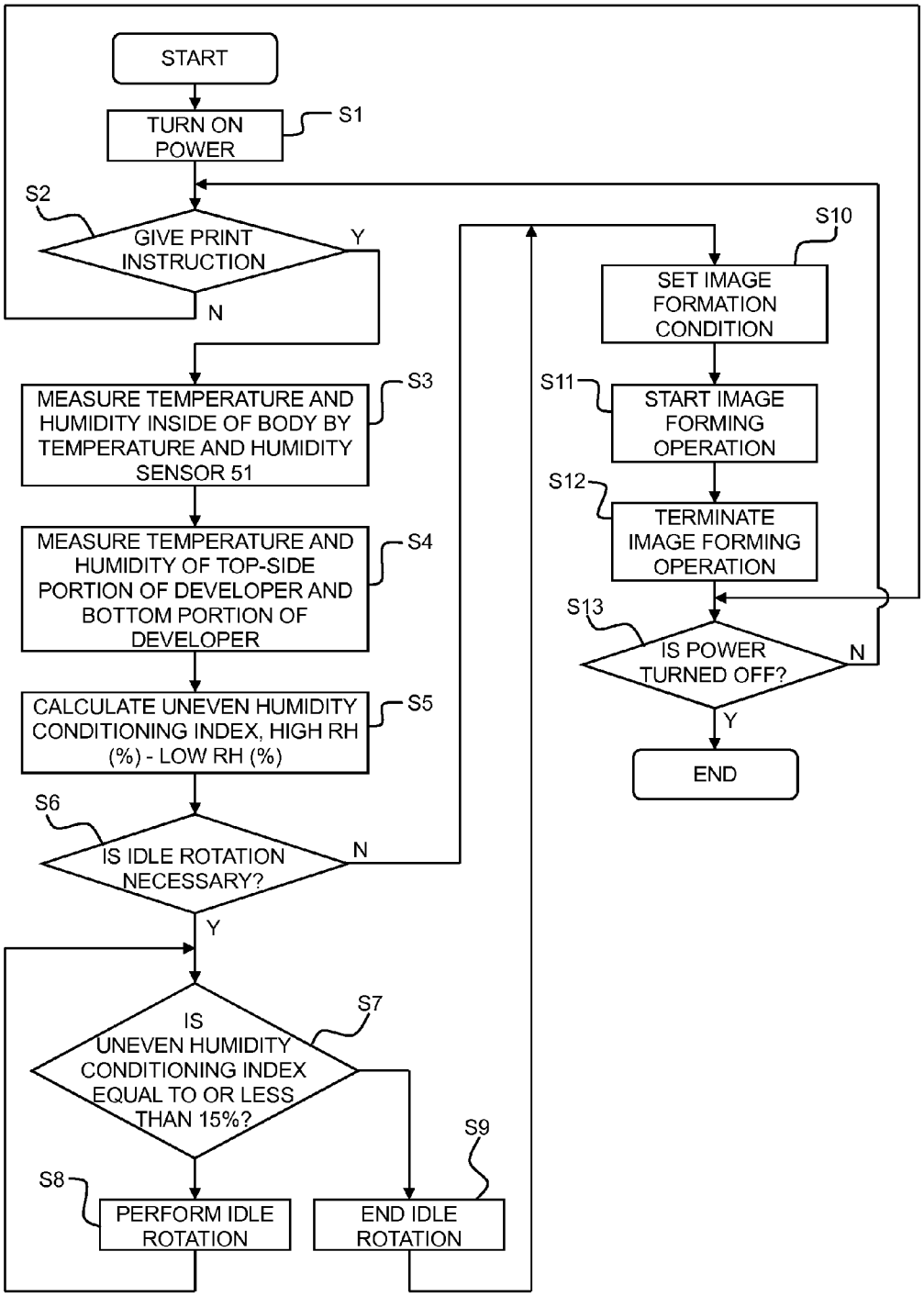
FIG. 5 is a flowchart illustrating a control flow of an image formation condition according to the first embodiment.

FIG. 5 is a flowchart illustrating a control flow of the image forming condition according to this embodiment. As illustrated in FIG. 5, power is first turned on (S1) and it is determined whether a print instruction is given (S2). When there is no print instruction in S2, it is determined whether the power is turned off (S13). When the power is not turned off in step S13, the process returns to S2 and the process stands by until a print instruction is given. When the power is turned off in S13, the control ends directly.

When the print instruction is given in S2, the temperature and humidity sensor 51 measures ambient temperature and humidity inside the image forming apparatus body (S3). The temperature and humidity sensors 52 and 53 measure the temperature and humidity of the top-side portion and the bottom portion of the developer and detect the uneven humidity conditioning of the developer (S4). The uneven humidity conditioning index (γ) is calculated from the humidity measurement values measured by the temperature and humidity sensors 52 and 53 (S5).

Based on the calculated uneven humidity conditioning index (γ), it is determined whether the idle rotation of the developer is necessary (S6). In this embodiment, when the uneven humidity conditioning index (γ) is greater than the predetermined threshold value (15% RH), it is determined that the idle rotation is necessary. This threshold value can be appropriately changed.

When it is determined that the idle rotation is not necessary in S6, the image formation condition determined in advance is set (S10) based on the results measured by the temperature and humidity sensors 51 to 53, and then an image forming operation is performed (S11). After the image forming operation ends (S12), it is determined whether the power is turned off (S13).

Conversely, when it is determined that the idle rotation is necessary in S6, the first screw 13 and the second screw 14 are rotated before the start of the image forming operation to alleviate the uneven humidity conditioning in the developer. As in S3 to S6, it is determined again whether the uneven humidity conditioning index (γ) is equal to or less than the threshold value (15% RH) (S7). The idle rotation is performed until the uneven humidity conditioning index (γ) is equal to or less than the threshold value (15% RH) in S7 (S8). When it is determined that the uneven humidity conditioning index (γ) is equal to or less than the threshold value (15% RH), the idle rotation ends (S9), and then the image forming operation is performed in S10 to S13.

In this embodiment, as described above, the uneven humidity conditioning of the actual developer is detected, the uneven humidity conditioning is resolved through the optimum idle rotation time (number of idle rotations), the image formation condition is changed based on the temperature and humidity detected by the temperature and humidity sensors 51 to 53, and then the image forming operation is performed. Therefore, it is possible to prevent the variation in color from deteriorating due to the uneven humidity conditioning since the idle rotation time is too short. Further, when a non-running time is long, it is possible to prevent an image failure such as an unclear image caused due to the acceleration of toner deterioration and a transfer failure since the idle rotation time is too long. Furthermore, it is possible to improve productivity, since unnecessary idle rotation is not performed.

In this embodiment, it is determined whether the idle rotation is necessary based on the temperature and humidity sensor, but the following configuration may be realized. That is, it is basically configured that the idle rotation is performed for a predetermined time whenever an image forming operation starts, and it is determined whether the idle rotation is further performed based on the temperature and humidity sensor. In this case, when it is determined that the uneven humidity conditioning occurs based on the temperature and humidity sensor (when the uneven humidity conditioning index (γ) is equal to or greater than the threshold value (15% RH)), the idle rotation time may be set to be long.

Second Embodiment

Figure 8:
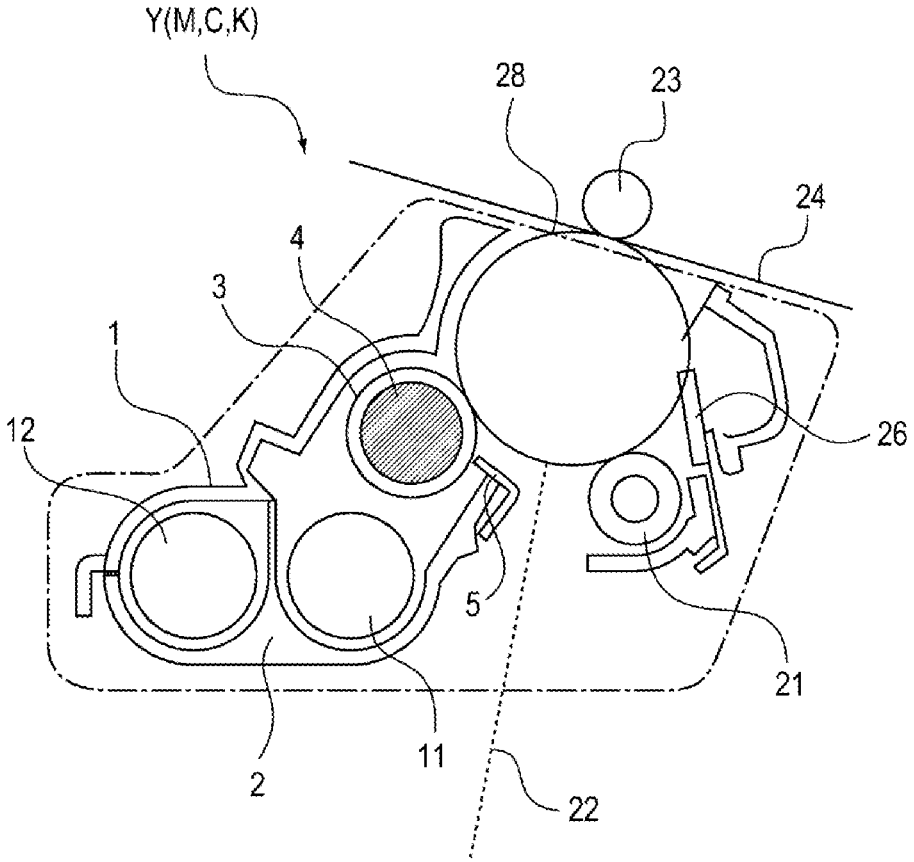
FIG. 8 is a diagram illustrating the configuration of a drum cartridge of an image forming apparatus according to a second embodiment.

Next, an image forming apparatus according to a second embodiment of the invention will be described with reference to the drawings. The same reference numerals are given to portions repeated in the description of the first embodiment, and the description thereof will not be repeated. FIG. 8 is a diagram illustrating the configuration of a drum cartridge of the image forming apparatus according to this embodiment.

As illustrated in FIG. 8, the image forming apparatus according to this embodiment includes a temperature sensor (an acquiring portion and a temperature measuring unit) 54 instead of the temperature and humidity sensors 52 and 53. The temperature sensor 54 is installed near a developing container. That is, in this embodiment, the temperature and humidity of the developer is not directly measured, as in the first embodiment. Therefore, the controller 301 accurately predicts the humidity in the developer using values measured by the temperature and humidity sensor 51 and the temperature sensor 54.

Hereinafter, the order of prediction of the relative humidity in the developer and prediction of uneven humidity conditioning will be described in detail.

First, absolute humidity (g/m$^3$) is calculated using temperature T measured by the temperature and humidity sensor 51 of the image forming apparatus and Expressions 1 and 2 below.

$$\text{Saturated Water Vapor Pressure(Pa)} = 611 \times 10^{7.5 \times \textit{Temperature T}/(\textit{Temperature T} + 237.3)} \quad \text{(Expression 1)}$$

$$\text{Saturated Absolute Humidity(g/m}^3\text{)} = \text{Saturated Water Vapor Pressure(Pa)} * 2.17/(\text{Temperature } T + 273.15) \quad \text{(Expression 2)}$$

Expression 1 is called a so-called empirical formula of Teten and is an expression used to calculate a saturated water vapor pressure at a given temperature T.

Expression 2 is a saturated absolute humidity calculation expression obtained by modifying the state equation of the ideal gas.

Here, since the absolute humidity is not varied (for example, in a constant temperature zone (the temperature of 30° C. and the humidity of 80%), the absolute humidity is 24.32 g/m$^3$) under the same environment, the change in the relative humidity caused due to a change in temperature can be obtained by simple calculation. In this embodiment, the temperature T (° C.) near the development device can be obtained by the temperature sensor 54 provided near the development device. Therefore, the relative humidity in the vicinity (ambience) of the development device can be likewise calculated by obtaining the saturated absolute humidity at the temperature T in Expressions 1 and 2 and dividing the current absolute humidity (24.32 g/m$^3$) by the value of the saturated absolute humidity.

Here, the calculated relative humidity near the development device is merely relative humidity of the ambience near the development device. When the relative humidity of the ambience is changed, the relative humidity in the ambience and the relative humidity of the developer are not necessarily the same as each other. When the relative humidity of the ambience is changed, it is necessary to calculate the relative humidity of the developer in consideration of the humidity conditioning (humidity conditioning speed). Hereinafter, a method of calculating the relative humidity of the developer will be described.

Here, depending on the stirring or non-stirring of the developer, the humidity conditioning time differs between the time of driving the development device 1 and the time of pausing the development device 1. Therefore, to correctly predict the humidity conditioning speed, two time constants of a time constant ($\alpha$1) of the driving time and a time constant ($\alpha$2) of the pausing time are used as time constants indicating the humidity conditioning speed.

Further, to accurately predict the uneven humidity conditioning of the developer, which may easily occur during the pause time (non-running time), within the developing container, two time constants of a humidity conditioning time constant ($\beta$1) of the top-side portion of the developer and a humidity conditioning time constant ($\beta$2) of the bottom portion of the developer are used.

The time constants $\alpha$1, $\alpha$2, $\beta$1, and $\beta$2 are calculated as follows. Specifically, the image forming apparatus 100 including the temperature and humidity sensors 52 and 53 according to the above-described first embodiment is first entered to a constant temperature zone in which the temperature of 25° C. and the humidity of 50% are set. Then, after the image forming apparatus 100 is continuously operated for 10 hours, the image forming apparatus 100 is paused for 8 hours. The temperature and humidity sensors 52 and 53 may be provided in an apparatus used to calculate the time constants $\alpha$1, $\alpha$2, $\beta$1, and $\beta$2. It is not necessary to provide the temperature and humidity sensors 52 and 53 in the image forming apparatus according to this embodiment.

The time constants $\alpha$1 and $\alpha$2 (=$\beta$1) are calculated from a humidity change curve of the temperature and humidity sensor 52, and the time constant ($\beta$2) of the bottom portion of the developer is calculated from a humidity change curve of the temperature and humidity sensor 53. Further, "$\alpha$2=$\beta$1" is assumed by setting the humidity value of the top-side portion of the developer as a target humidity of the entire developer.

An operation time of the image forming apparatus 100 necessary for the determination of the time constants is set to a time equal to or greater than a time until the temperature near the developer is saturated by fixing temperature conditioning during the operation or driving of a motor. Further, a pause time of the image forming apparatus 100 necessary for the determination of the time constants is set to a time equal to or greater than a time until the temperature near the developer drops up to a body installation environment temperature due to the pause and the humidity values of the temperature and humidity sensors 52 and 53 are converged to the substantially identical value.

In this embodiment, the time constants $\alpha$1, $\alpha$2 (=$\beta$1), and $\beta$2 of the humidity conditioning are 5 minutes, 240 minutes, and 360 minutes, respectively.

To calculate relative humidity RH of the developer, a model is used in which the humidity conditioning is performed with the time constant $\alpha$2 such that a previously calculated relative humidity RHm of the developer approximates current ambience humidity RHn. That is, the controller 301 calculates the relative humidity RH of the developer through approximation of an exponent function as in Expression 3 below. In Expression 3, RHm indicates the relative humidity of the developer previously calculated by Expression 3. RHn indicates relative humidity data of the current ambience calculated from the current temperature data measured by current the temperature sensor 54. Further, tm indicates time data (Day, Month, Year and Hour, Minute, Second) when the previous relative humidity of the developer is acquired and the temperature sensor 54 acquires the previous temperature data. Furthermore, tn indicates time data (Day, Month, Year and Hour, Minute, Second) at the current time.

$$RH(\%)=(RHm-RHn)\times\exp(-(tn-tm)/\alpha 2)+RHn \quad \text{(Expression 3)}$$

Figure 10:
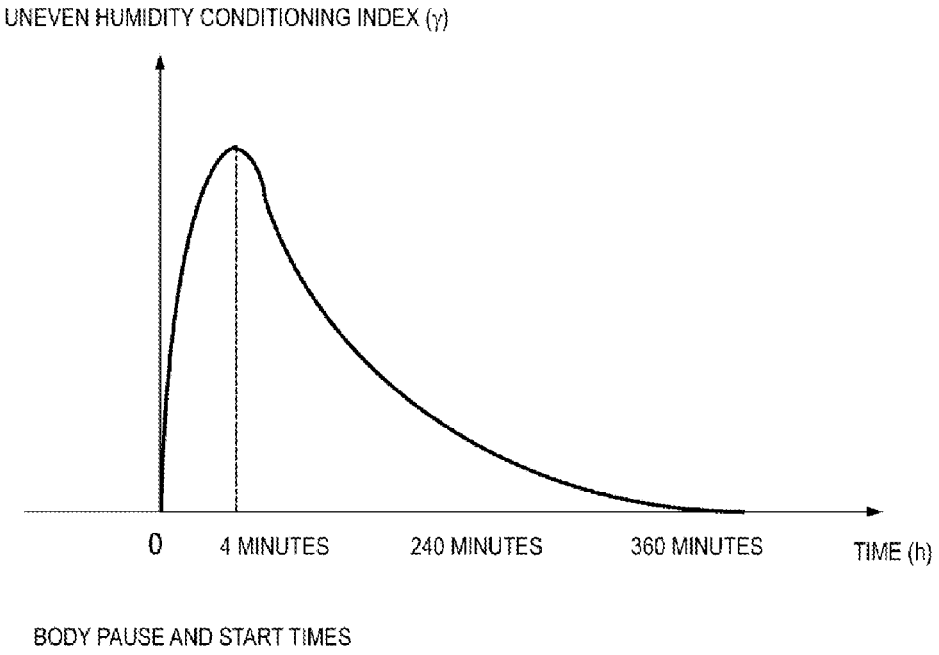
FIG. 10 is a diagram illustrating a relation between a body pause time and an uneven humidity conditioning index ($\gamma$) according to the second embodiment.

Next, a method of calculating a required idle rotation time corresponding to the uneven humidity conditioning index ($\gamma$) will be described. FIG. 10 is a diagram illustrating a transition of the uneven humidity conditioning index ($\gamma$) for the body pause (non-running) time based on the result of the above-described time constant determination experiment. It can be understood that there is a non-running time (4 minutes in the experiment) at which the uneven humidity conditioning is the maximum and the uneven humidity conditioning is alleviated over the non-running time. That is, it can be also understood that the idle rotation is performed only when the uneven humidity conditioning occurs, and the idle rotation is not necessary after the uneven humidity conditioning disappears for the non-running time of 360 minutes or more.

Next, while the idle rotation is performed in the presence state of the uneven humidity conditioning, the time at which the humidity detection results of the temperature and humidity sensors 52 and 53 are substantially the same may be determined according to the uneven humidity conditioning index ($\gamma$). The required idle rotation time corresponding to the uneven humidity conditioning index ($\gamma$) is stored as a table on the CPU of the body.

Figure 9:
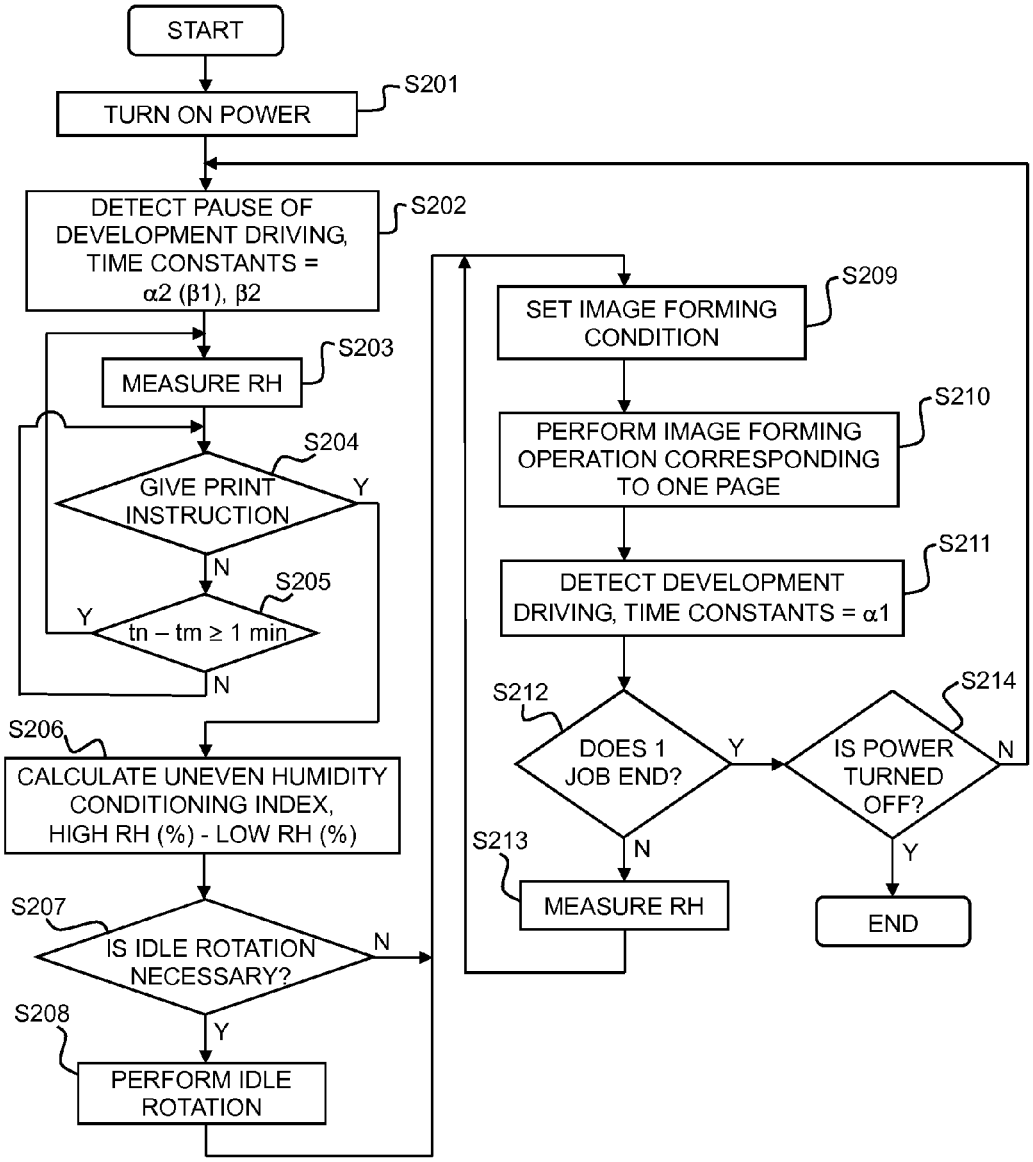
FIG. 9 is a flowchart illustrating a control flow of an image formation condition according to the second embodiment.

FIG. 9 is a flowchart illustrating a control flow of the image formation condition according to this embodiment. As illustrated in FIG. 9, when the power is first turned on (S201), it is detected that driving of the development device 1 is paused, the time constant "$\alpha$2=240" at the time of the pause is set (S202), and a relative humidity value (RH %) is calculated (S203).

When the pause of the driving of the development device is detected in S202, the uneven humidity conditioning in the developer side occurring at the time of pausing the development device starts to be calculated. Specifically, as expressed in Expressions 4 and 5 below, the time constant is substituted with the time constant "$\beta$1 (=$\alpha$2)=240 minutes" to predict the humidity state (high RH (%)) of the top-side portion of the developer. Further, when the process proceeds to S209 to be described below, the image forming operation ends, and then the process returns to S202, the time constant is substituted with the time constant "$\beta$2=360 minutes" to predict the humidity state (low RH (%)) of the bottom portion of the developer. Then, by repeating recalculation of RH in S203, the uneven humidity conditioning (humidity change characteristic difference) in the developer is calculated.

$$\text{High } RH(\%)=(RHm-RHn)\times\exp(-(tn-tm)/\beta 1)+RHn \quad \text{(Expression 4)}$$

$$\text{Low } RH(\%)=(RHm-RHn)\times\exp(-(tn-tm)/(32)+RHn \quad \text{(Expression 5)}$$

Then, it is determined whether a print instruction is given (S204). When the print instruction is not given in S204, a value of "tn−tm" is calculated and it is determined whether this value is equal to or greater than 1 minute (S205). When it is determined in S205 that the value is equal to or greater than 1 minute, the process returns to S203 again and RH is calculated. Conversely, when it is determined in S205 that the value is less than 1 minute, the process returns to S204 without calculation of RH and printing stands by.

Conversely, when the print instruction is given in S204, the uneven humidity conditioning index (γ) is calculated using Expression 6 below (S206).

$$\text{Uneven Humidity Conditioning Index}(\gamma)=|\text{high RH}(\%)-\text{low RH}(\%)| \quad \text{(Expression 6)}$$

Then, it is determined whether the idle rotation is necessary according to the calculated uneven humidity conditioning index (γ) (S207). When it is determined in S207 that the idle rotation is necessary, the idle rotation is performed only for the required idle rotation time using the required idle rotation time according to the uneven humidity conditioning index (γ) stored as the table, and then the process proceeds to S209 (S208). Conversely, when it is determined in S207 that the idle rotation is not necessary, the idle rotation of the screws 13 and 14 is not performed and the process proceeds to S209.

In S209, the image formation condition predetermined in advance is first set. Then, an image forming operation corresponding to one page is performed (S210). Then, the driving of the development device 1 is detected and the time constant "α1=5 minutes" in the RH calculation expression is set (S211). Thereafter, it is determined whether the image forming operation corresponding to one page ends (S212).

When the job does not end in S212, RH is calculated again using Expression 7 below (S213).

$$\text{RH}(\%)=(\text{RH}m-\text{RH}n)\times\exp(-(tn-tm)/\alpha 1)+\text{RH}n \quad \text{(Expression 7)}$$

The relative humidity data RHm stored on a memory of the controller 301 is changed to the value of RH calculated at this time, the process returns to S209, and a subsequent image forming operation is performed. Then, the operations of S209 to S213 are repeated until one job ends.

When the job ends in S212, it is determined whether the power is turned off (S214). When the power is not turned off in S214, the process returns to S202. When the power is turned off in S214, the control ends directly.

By performing the control of S206 to S208 in the control flow of this embodiment, the uneven humidity conditioning of the developer in the developing container occurring during the pause of the development device 1 can be resolved and the image forming operation can start in this state. Therefore, it is possible to prevent occurrence of an image failure caused due to an irregular toner charging amount distribution.

In this embodiment, the time constant α2 of the developer pause time is set to be the same as the time constant β1 of the pause time of the top-side portion of the developer. However, the invention is not limited thereto. For example, the time constant α of the developer pause time may be set to an average of the time constant β1 of the top-side portion of the developer and the time constant β2 of the bottom portion of the developer. That is, "α2=(240+360)/2=300" may be set. Further, the invention is not limited to the configuration in which the temperature sensor 54 is disposed near the developing container of each color, as described in this embodiment. For example, the temperature sensor 54 may be disposed near the drum cartridge of each color.

Third Embodiment

Next, an image forming apparatus according to a third embodiment of the invention will be described with reference to the drawings. The same reference numerals are given to portions repeated in the description of the first embodiment, and the description thereof will not be repeated.

The image forming apparatus according to this embodiment does not include the temperature sensor 54 of the image forming apparatus of the above-described second embodiment. A controller 301 performs control by predicting temperature near a developing container with high accuracy using only the temperature and humidity sensor 51 which measures the ambience of the surrounding of the image forming apparatus.

That is, in this embodiment, the temperature near the developing container may not be measured directly, unlike the above-described second embodiment. Therefore, when a speed (developer humidity conditioning speed) at which the developer is familiar with the humidity of the surrounding is predicted, the temperature near the developing container is predicted accurately, conversion to relative humidity in the developer and calculation of an uneven humidity conditioning index are performed using the prediction result as in the above-described second embodiment, it is determined whether the idle rotation is necessary or unnecessary.

Next, prediction of the temperature near the developing container will be described in detail. As described above, the temperature near the developing container due to the activation of the body increases and is converged to saturated temperature. Accordingly, a temperature increase prediction function expressed by Expressions 8 and 9 below is used.

$$C_{t+\Delta t}=C_t+\Delta C \quad \text{(Expression 8)}$$

$$\Delta C=\kappa_u(C_u-C_t) \quad \text{(Expression 9)}$$

In the expressions, $C_t$ is a current temperature, $C_{t+\Delta t}$ is a predicted temperature after Δt seconds, and $C_u$ is a saturated temperature convergence value at the time of a temperature increase. In this case, when an initial temperature $C_0$ and the convergence value $C_u$ are known, the $\kappa_u$ value which is the most suitable for the actually measured value can be determined and the predicted temperature can be calculated.

On the other hand, even when the temperature near the developing container drops due to the pause of the body and is converged to the saturated temperature, a temperature drop prediction function expressed by Expressions 10 and 11 below is used, as in the temperature increase prediction function.

$$C_{t+\Delta t}=C_t+\Delta C \quad \text{(Expression 10)}$$

$$\Delta C=\kappa_d(C_d-C_t) \quad \text{(Expression 11)}$$

In the expressions, $C_t$ is a current temperature, $C_{t+\Delta t}$ is a predicted temperature after Δt seconds, and $C_d$ is a saturated temperature convergence value (an environment temperature at which the body is installed) at the time of a temperature drop. In this case, when an initial temperature $C_0$ and the convergence value $C_d$ are known, the $\kappa_d$ value which is the most suitable for the actually measured value can be determined and the predicted temperature can be calculated.

Accordingly, the temperature near the developing container can be predicted by appropriately using Expressions 8 and 9 of the temperature increase prediction function and Expressions 10 and 11 of the temperature drop prediction function according to the body activation state and the body pause state.

$C_u$, $\kappa_u$, and $\kappa_d$ are calculated from an experiment. For example, the image forming apparatus 100 including the developing container 2 to which a temperature measurable unit such as a thermocouple is attached near the development device is installed in a constant temperature zone in which the temperature of 25° C. and the humidity of 50% are set. After the image forming apparatus 100 is continuously operated for 10 hours, the image forming apparatus 100 is paused for 8 hours and $C_u$, $\kappa_u$, and $\kappa_d$ are calculated. Specifically, $C_u$ of "the installation environment temperature+12.5," $\kappa_u$ of 0.0021, and $\kappa_d$ of 0.00014 are calculated as the above parameters of this embodiment.

As the body activation time necessary for the determination of the parameters $C_u$ and $\kappa_u$, a time is necessary which is equal to or greater than a time until the temperature near the developing container is saturated by fixing temperature conditioning during the operation of the body or driving of a motor. Likewise, a body pause time necessary for the determination of the parameter $\kappa_d$, a time is necessary which is equal to or greater than a time until the temperature near the developing container drops up to the body installation environment temperature due to the pause of the body.

It is confirmed that there is no difference between the increasing temperature and dropping temperature characteristics due to a body installation environment temperature difference. That is, when the body installation environment temperature is higher by 5° C. (for example, when the temperature is set from 25° C. to 30° C.), an increasing temperature difference temperature from the initial temperature is not changed in spite of the fact that the achieving temperature increase by 5° C.

In this embodiment, only the developing container of one color has been described. However, the temperature increase characteristics considerably depend on an installation position of each developing container. Accordingly, by determining the parameters $C_u$, $\kappa_u$, and $\kappa_d$ determined in this embodiment for each color, the temperature prediction accuracy can be improved.

According to the invention, since high accurate control is performed by exactly comprehending the humidity conditioning behavior of the developer at the time of driving and pause of the image forming apparatus, stability of density and color can be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-044980, filed Mar. 1, 2012, which is hereby incorporated by reference herein in its entirety.

What is claimed is:

1. An image forming apparatus comprising:

an image bearing member which bears an electrostatic latent image;

a development device which includes a developer bearing member conveying developer to a development position facing the image bearing member that bears the electrostatic latent image to develop the electrostatic latent image born on the image bearing member, a developing container containing the developer, and a stirring member stirring the developer inside the developing container;

a first detecting portion disposed at a position to contact with the developer in the developing container and detect information regarding humidity of the developer;

a second detecting portion disposed at a different position from the first detecting portion to contact with the developer in the developing container and detect information regarding humidity of the developer; and a controller which starts image forming after driving the stirring member for a predetermined period after receiving an image forming signal, wherein the controller controls to extend the predetermined period when a difference between the detecting result from the first detecting portion and the second detecting portion is larger than a predetermined value.

2. The image forming apparatus according to claim 1, wherein the first detecting portion and the second detecting portion are disposed at different depth positions in the developer.

3. The image forming apparatus according to claim 1, the developing container further comprising:

a first chamber which feeds the developer to the image bearing member;

a second chamber connected with the first chamber through first and second communication portions at opposite ends to form a circulating path for the developer;

a partition wall which separates the first chamber and the second chamber, a first conveying member able to rotate in the first chamber for conveying the developer; and a second conveying member able to rotate in the second chamber for conveying the developer;

wherein the first detecting portion and the second detecting portion are both disposed at one of the first and second communication portions.

* * * * *